US006966284B2

(12) United States Patent
Tawa et al.

(10) Patent No.: US 6,966,284 B2
(45) Date of Patent: Nov. 22, 2005

(54) OUTBOARD MOTOR

(75) Inventors: Hiroki Tawa, Wako (JP); Keiichiro Bungo, Wako (JP); Makoto Yonezawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/873,460

(22) Filed: Jun. 23, 2004

(65) Prior Publication Data

US 2005/0016479 A1 Jan. 27, 2005

(30) Foreign Application Priority Data

Jun. 25, 2003 (JP) ..... 2003-180994

(51) Int. Cl.[7] ..... F01L 9/02

(52) U.S. Cl. ..... 123/90.12; 123/90.15; 123/193.3; 123/195 P; 440/89 G; 440/89 R; 440/89 D; 440/900

(58) Field of Search ..... 123/90.12, 90.15, 123/193.3, 195 P; 440/89 R, 89 D, 89 G, 440/900; 60/276

(56) References Cited

U.S. PATENT DOCUMENTS 5,908,338 A * 6/1999 Kawasaki et al. ..... 440/89 R
6,053,785 A * 4/2000 Kato et al. ..... 440/89 R
6,315,624 B1 * 11/2001 Tetzlaff et al. ..... 440/89 R
6,439,938 B1 * 8/2002 Katayama ..... 440/88 R
6,705,264 B2 * 3/2004 Onoue ..... 123/90.39
6,708,659 B2 * 3/2004 Katayama ..... 123/90.31
2004/0206321 A1 * 10/2004 Katayama ..... 123/90.15

FOREIGN PATENT DOCUMENTS

JP 7-301135 11/1995
JP 2000-186516 7/2000

* cited by examiner

*Primary Examiner*—Thomas Denion
*Assistant Examiner*—Kyle M. Riddle
(74) *Attorney, Agent, or Firm*—Squire, Sanders & Dempsey LLP

(57) ABSTRACT

There is provided an outboard motor (1), comprising: an intake valve (17) and an exhaust valve (18) provided to a cylinder head (14); a camshaft (20) arranged substantially vertically in the cylinder head to open and close the intake and exhaust valves; a valve operation characteristics changing device (29) hydraulically operated to change operation characteristics of at least one of the intake and exhaust valves; a selector valve (electromagnetic valve 27) for controlling an oil pressure provided to the valve operation characteristics changing device; and an exhaust passage component part (exhaust manifold 23) secured on a side of the cylinder head, wherein the selector valve is disposed at a position (space G) beside the cylinder head and overlapping with a top end surface of the exhaust passage component part.

5 Claims, 5 Drawing Sheets

OUTBOARD MOTOR

TECHNICAL FIELD

The present invention relates to an outboard motor, and more specifically relates to an outboard motor comprising an engine in which valve operation characteristics of an intake or discharge valve of the engine can be variably controlled depending on an engine rotational speed.

BACKGROUND OF THE INVENTION

It has been known to use a valve operation characteristics changing device in an outboard motor where the valve operation characteristics changing device is adapted to variably control operation characteristics of intake and exhaust valves for controlling supply of air-fuel mixture and discharge of combustion gas, respectively, depending on an operational condition of an engine of the outboard motor, to whereby achieve low fuel consumption and high output over a wide operation range (see Japanese Patent Application Laid-Open (kokai) No. 2000-186516).

On the other hand, in order to optimally control the air-fuel ratio to achieve higher combustion efficiency, it is desired to provide an exhaust gas property sensor at an appropriate position in an exhaust passage (see Japanese Patent Application Laid-Open (kokai) No. 7-301135).

However, in the conventional structure disclosed in the above-mentioned JPA Laid-Open No. 2000-186516, a selector valve for controlling the valve operation characteristics changing device is accommodated in a head cover for covering a valve gear mechanism, which results in a larger head cover. This leads to a larger engine cover and increases an amount of overhang in a tilt-up position, which is unfavorable in outboard motors where the engine cover having a smaller outer profile is preferred. Further, the exhaust gas property sensor protrudes from the component parts constituting the exhaust passage, and this can also hinder achieving a smaller engine cover.

BRIEF SUMMARY OF THE INVENTION

In view of such problems of the prior art, a primary object of the present invention is to provide an outboard motor constructed to minimize the increase in size of the engine cover.

According to the present invention, such objects can be accomplished by providing an outboard motor (1), comprising: an intake valve (17) and an exhaust valve (18) provided to a cylinder head (14); a camshaft (20) arranged substantially vertically in the cylinder head to open and close the intake and exhaust valves; a valve operation characteristics changing device (29) hydraulically operated to change operation characteristics of at least one of the intake and exhaust valves; a selector valve (electromagnetic valve 27) for controlling an oil pressure provided to the valve operation characteristics changing device; and an exhaust passage component part (exhaust manifold 23) secured on a side of the cylinder head, wherein the selector valve is disposed at a position (space G) beside the cylinder head and overlapping with a top end surface of the exhaust passage component part.

In this way, the control valve of the valve operation characteristics changing device can be mounted at a place that otherwise would be a dead space in the engine, and thus increase in size of the engine cover can be avoided.

According to a preferred embodiment of the present invention, the outboard motor further comprises an exhaust gas property sensor (28) for sensing an exhaust gas property of an engine, wherein the exhaust gas property sensor is secured on the top end surface of the exhaust passage component part. This allows the oil pressure control valve for the valve operation characteristics changing device and the exhaust gas property sensor to be placed at a position where they do not interfere with an engine cover, and therefore increase in the size of the engine cover can be avoided.

Preferably, the selector valve and the exhaust gas property sensor are arranged in a front-to-back direction. This can improve an efficiency of utilization of the space inside the engine cover while preventing increase in the widthwise dimension of the engine cover.

Further preferably, the exhaust passage component part extends from a joint with the cylinder head to a lateral side of the camshaft, and the exhaust gas property sensor of the engine is disposed at an end portion of the exhaust passage component part closer to the camshaft. This can achieve efficient utilization of a space that is formed for ensuring a sufficient length of the exhaust passage and that would otherwise be a dead space.

Other and further objects, features and advantages of the invention will appear more fully from the following description.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
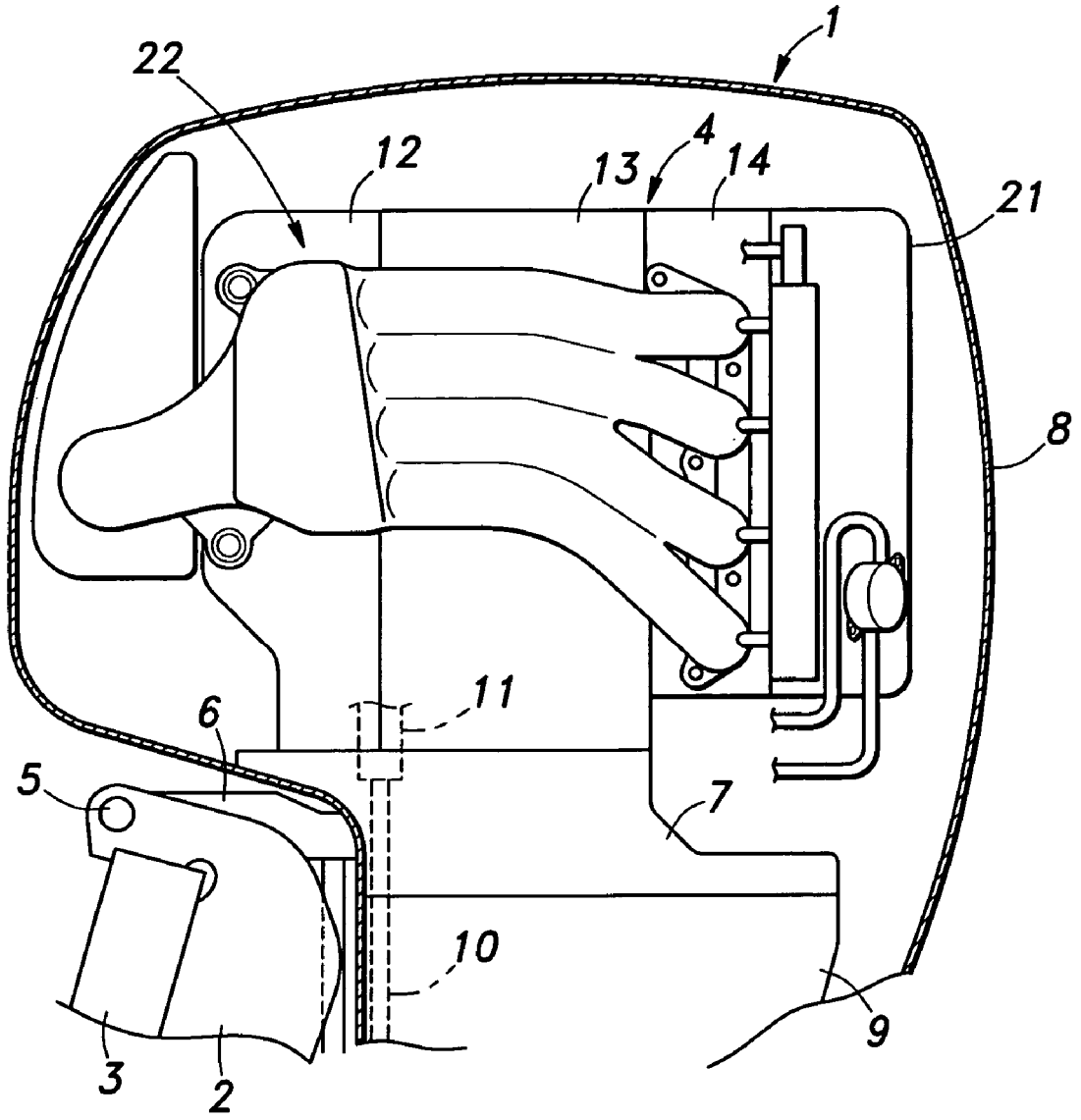
FIG. 1 is a side view showing an essential part of an outboard motor to which the present invention is applied, with part thereof being cut away.
Figure 2:
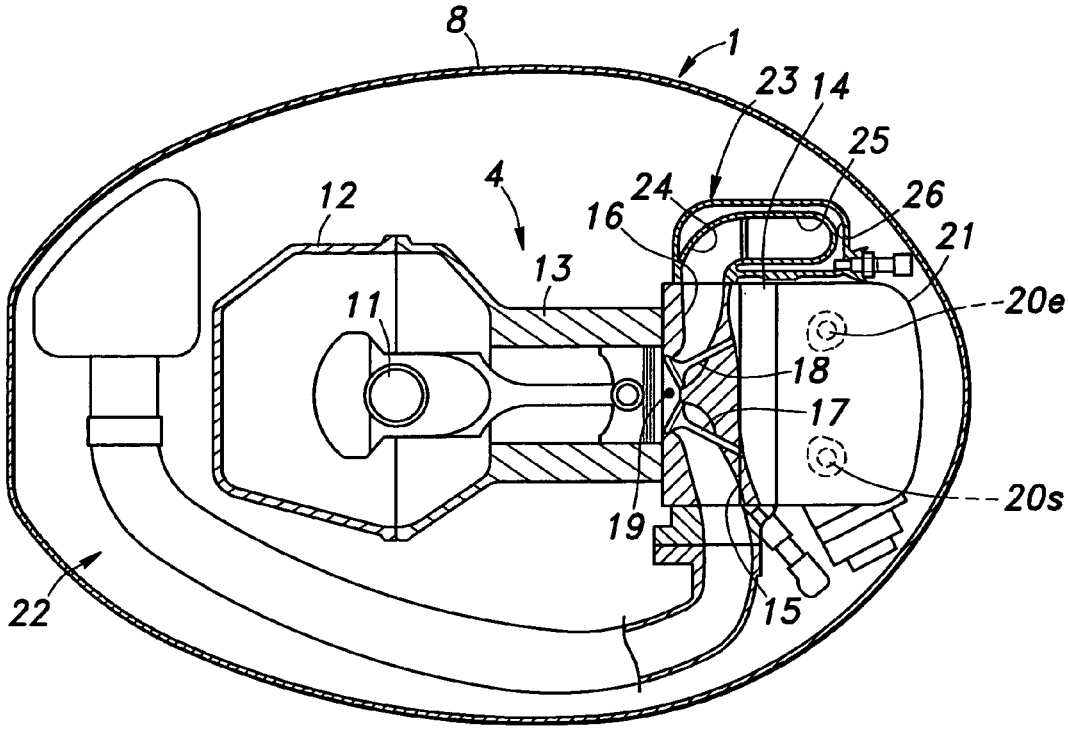
FIG. 2 is a top plan view showing an outboard motor to which the present invention is applied, with part thereof being cut away.

FIGS. 1 and 2 show a portion around an engine of an outboard motor constructed according to the present invention. This outboard motor 1 is a known type adapted to be attached to a stem plate 3 via a stern bracket 2, and its engine 4 is mounted on a mount case 7 that is substantially integral with swivel case 6 which in turn is connected to the stem bracket 2 so as to be pivotable around a laterally extending tilt shaft 5. A substantially whole part of the engine 4 mounted on the mount case 7 is covered by a detachable engine cover 8.

The mount case 7 is fixed on top of an extension case 9, and a drive shaft 10 extending to a screw is coupled to a crank shaft 11 inside the mount case 7.

The engine 4 may for example consist of a vertical crankshaft engine of a 4-cylinder in-line type, which comprises a crankcase 12, cylinder block 13 and cylinder head 14, and is arranged such that the crankcase 12 faces in a forward direction when the watercraft is traveling. The cylinder head 14 is formed with a combustion chamber 19 which is intermittently brought into flow communication with an intake port 15 and an exhaust port 16 via an intake valve 17 and an exhaust valve 18, respectively (FIG. 2). Further, a head cover 21 for covering a camshaft 20*s* for driving the intake valve 17 and a camshaft 20*e* for driving the exhaust valve 18 is coupled to a right end side of the cylinder head 14 in the drawing, with a gasket 72 (FIG. 5) being interposed between the cylinder head 14 and the head cover 21.

An intake device 22 for supplying air/fuel mixture to the intake port 15 is disposed at one lateral side of the crankcase 12, cylinder block 13 and cylinder head 14 so as to oppose them. On the other lateral side of the cylinder head 14 is disposed an exhaust manifold 23 for discharging combustion gas from the exhaust port 16.

The exhaust manifold 23 is formed with: exhaust passages 24 which are provided for respective cylinders and each extend substantially in parallel with a cylinder shaft from a coupling end coupled to an opening surface of the exhaust port 16 of the cylinder head 14 toward a lateral side portion of the head cover 21 covering the camshaft; an exhaust chamber 25 connected to a downstream end of each exhaust passage 24 and extending substantially in parallel with the crankshaft 11 (camshaft); and a water jacket 26 that surrounds the exhaust passages 24 and the exhaust chamber 25. An end of the exhaust chamber 25 away from a crank pulley, i.e., a lower end, is connected to an upper surface of the mount case 7 so that the combustion gas is discharged into the extension case 9. A portion of the exhaust manifold 23 connected to the upper surface of the mount case 7 is also attached with a hose 74 in order to allow discharge of engine cooling water from a thermostat case 73 which is provided on an end of the cylinder head 14 on the crank pulley side.

Figure 3:
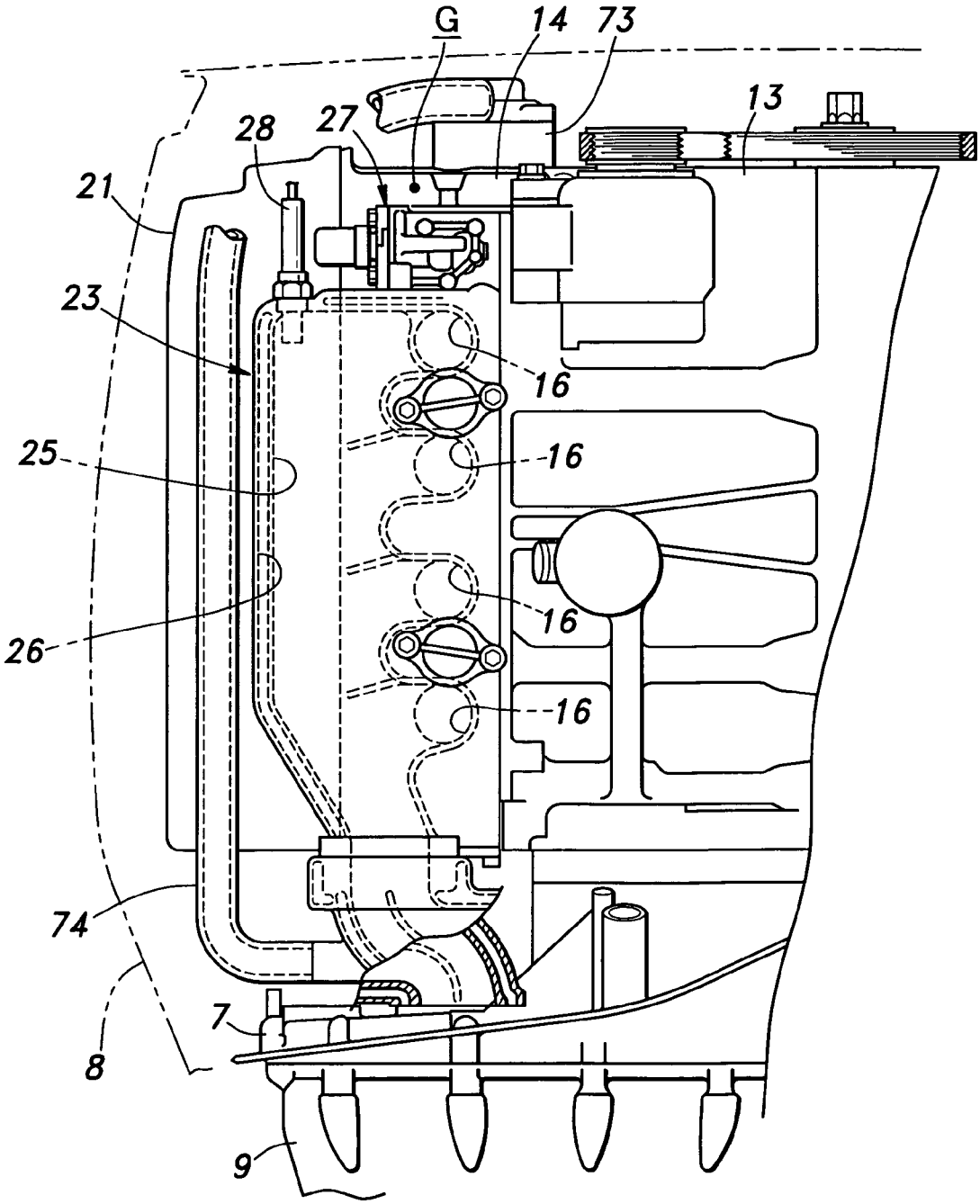
FIG. 3 is a side view showing an essential part of an exhaust side of an engine for an outboard motor to which the present invention is applied.

As shown in FIG. 3, the end surface of the cylinder head 14 on the crank pulley side, i.e., an upper end surface, is offset from an upper end surface of the exhaust manifold 23 in an axial direction of the crankshaft 11 such that the offset defines a space G at the lateral side of an upper end portion of the cylinder head 14 away from the intake device 22. In this space G, an electromagnetic valve 27 for controlling a valve operation characteristics changing device, which will be described later, is securely mounted. Further, on an end portion of the upper end surface of the exhaust manifold 23 close to the camshaft, an exhaust gas property sensor 28 is securely mounted so as to be adjacent to the electromagnetic valve 27.

The intake valves 17 of the engine 4 are provided with a valve operation characteristics changing device 29. In the following, the valve operation characteristics changing device 29 is explained with reference to FIG. 4. It should be noted that the valve operation characteristics changing device 29 is provided for each of the cylinders although only one of them will be explained below.

Figure 4:
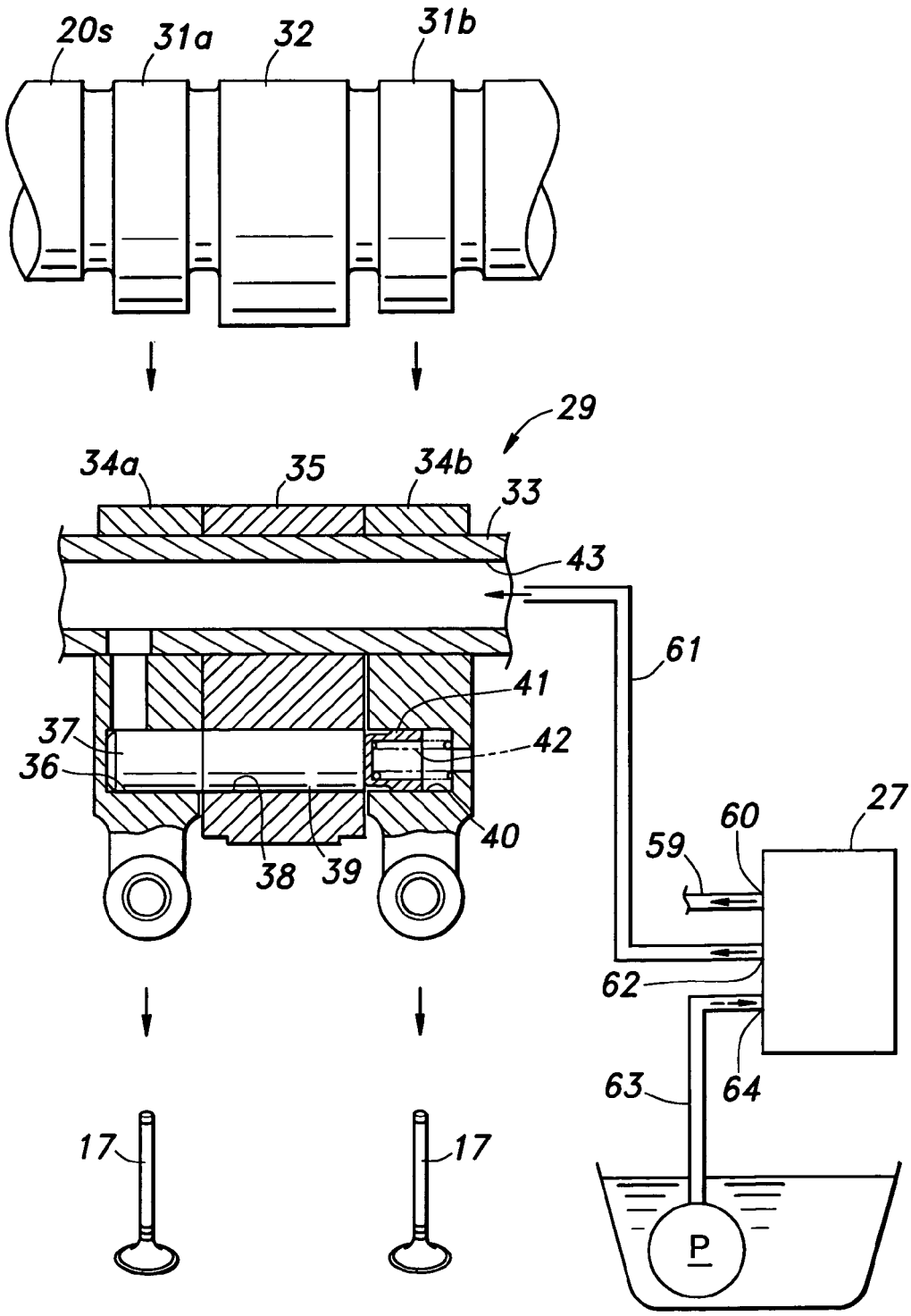
FIG. 4 is a schematic view of a valve operation characteristics changing device.

As seen in FIG. 4, the intake camshaft 20*s* is integrally formed with a pair of low-speed cams 31*a*, 31*b* for providing a relatively small valve operating angle and lift amount, and a high-speed cam 32 for providing a relatively large valve operating angle and lift amount where the high-speed cam 32 is interposed between the low-speed cams 31*a*, 31*b*. Below the intake camshaft 20*s*, three rocker arms 34*a*, 35, 34*b* are rotatably supported on a rocker shaft 33 extending in parallel with the intake camshaft 20*s*, where the rocker arms 34*a*, 35, 34*b* are disposed one next to the other such that they can be angularly displaced relative to each other. The rocker arms 34*a*, 35, 34*b* are adapted to be rotatably driven by the corresponding cams 31*a*, 32, 31*b*, respectively.

The low-speed rocker arms 34*a*, 34*b* which are driven by the low-speed cams 31*a*, 31*b* essentially have an identical shape and their free ends abut stern ends of the two intake valves 17 which are always spring-urged in the closing direction. The high-speed rocker arm 35 which is driven by the high-speed cam 32 is always kept in a slidable contact with the high-speed cam 32 by a spring member not shown in the drawing.

Inside the mutually adjoining three rocker arms 34*a*, 35, 34*b* is provided a selective coupling mechanism for selectively achieving a low-speed mode in which the rocker arms are allowed to be angularly displaced relative to each other and a high-speed mode in which the rocker arms can be rotated in a unit. In the following, the selective coupling mechanism is described in detail.

Referring to FIG. 4, the low-speed rocker arm 34*a* on the left is formed with a first guide hole 36 which opens out towards the center-positioned high-speed rocker arm 35 and is closed at the other end, where the guide hole 36 extends in parallel with the axis of the rocker shaft 33 and a first selective coupling pin 37 is slidably received therein. The high-speed rocker arm 35 is formed with a second guide hole 38 passing therethrough such that the second guide hole 38 is aligned with the first guide hole 36 in a rest position where a round base portion of the high-speed cam 32 is slidably contacts the cam slipper. Further, a second selective coupling pin 39 is received in the second guide hole 38 so that one end of the second selective coupling pin 39 abuts the first selective coupling pin 37.

Like the left low-speed rocker arm 34*a*, the right low-speed rocker arm 34*b* in FIG. 4 is formed with a third guide hole 40 which is substantially closed at one end, and a stopper pin 41 is slidably received therein such that one end of the stopper pin 41 abuts the other end of the second selective coupling pin 39. The stopper pin 41 is always urged toward the high-speed rocker arm 35 by a compression coil spring 42.

The rocker shaft 33 is internally provided with an oil supply passage 43 for conducting engine oil pumped up from an oil pan by a pump P. The oil supply passage 43 is in flow communication with a bottom of the first guide hole 36 as well as with passages (not shown in the drawing) for supplying the engine oil to the contact surfaces between the rocker shaft 33 and each of the rocker arms 34*a*, 35, 34*b*, the sliding surfaces between each of the cams 31*a*, 32, 31*b* and the cam slippers, and the cam journals.

The above described selective coupling mechanism is operated by open/close controlling the electromagnetic valve 27 depending on an operating condition of the engine 4 and thereby intermittingly transmitting an oil pressure to the first selective coupling pin 37 in the first guide hole 36 through the oil supply passage 43.

In the low-speed mode, the first selective coupling pin 37 is not applied with a high oil pressure, and a resilient force from the compression coil spring 42 brings each pin 37, 39, 41 into alignment with the corresponding guide hole 36, 38, 40 (a state shown in FIG. 4). In this state, the rocker arms 34*a*, 35, 34*b* can be angularly displaced relative to each other. In other words, the rocker arms 34*a*, 35, 34*b* can individually undergo a rocking motion. Therefore, the high-speed rocker arm 35 driven by the high-speed cam 32 would not affect the other rocker arms 34*a*, 34*b*, and the two intake valves 17 are simultaneously driven by the low-speed rocker arms 34*a*, 34*b* which are driven by the low-speed cams 31*a*, 31*b* having a relatively small lift amount and valve operating angle.

In the high-speed mode, a high oil pressure is applied to the first selective coupling pin 37 through the oil supply passage 43, and the first and second selective coupling pins 37, 39 are pushed out from the first and second guide holes 36, 38, respectively, against the resilient force of the compression coil spring 42. This causes the first and second selective coupling pins 37, 39 to sit across adjoining ones of the rocker arms 34*a*, 35, 34*b*. Therefore, the rocker arms 34*a*, 35, 34*b* are joined to each other so as to be rotatable as a unit, and accordingly the two intake valves 17 are simultaneously driven by the high-speed cam 32 having a relatively large lift amount and valve operating angle.

Figure 5:
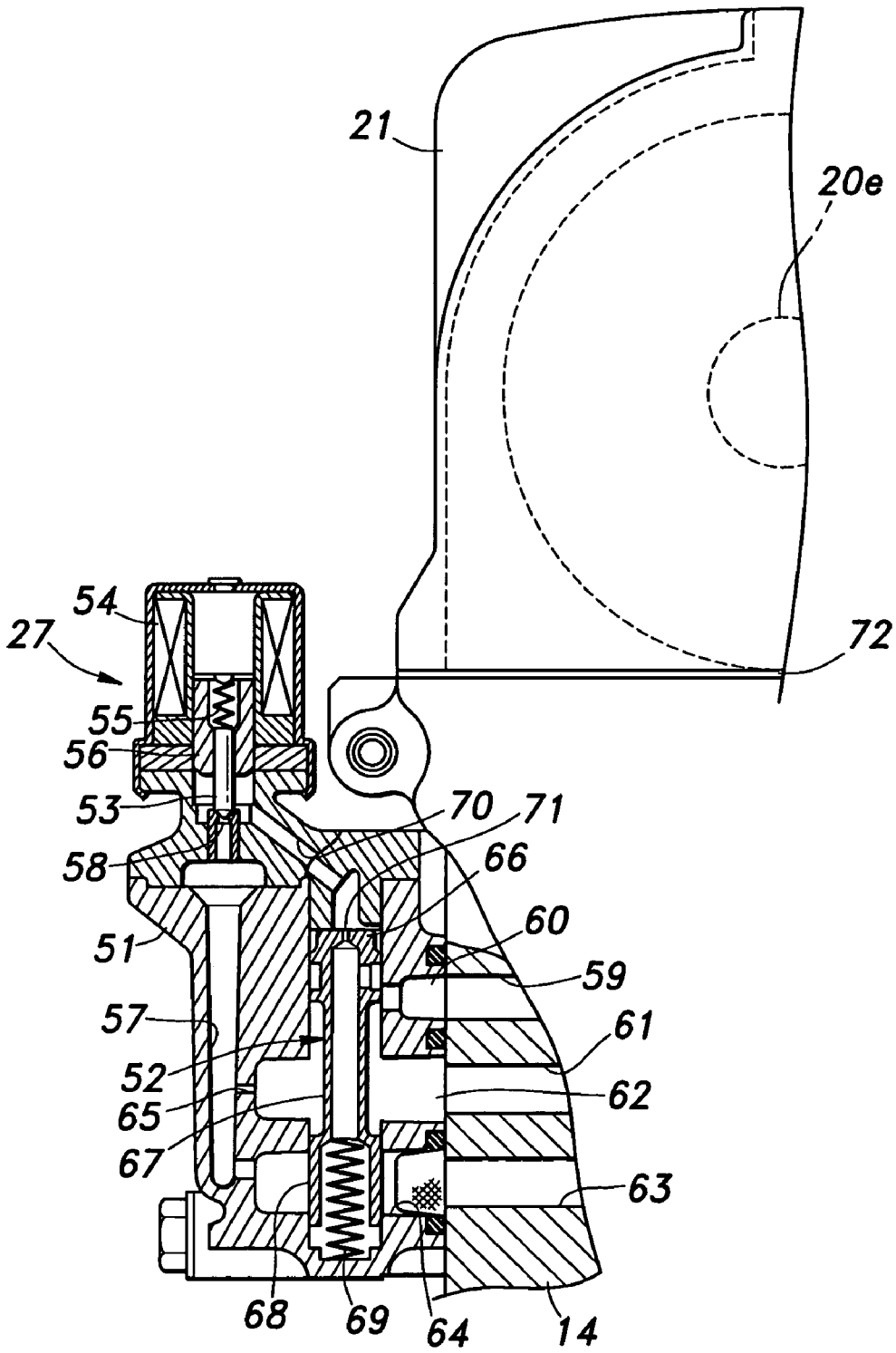
FIG. 5 is a structural view of an electromagnetic valve.

Next, an explanation is made as to the electromagnetic valve 27 for operating the above-described valve operation characteristics changing device 29 between the low-speed mode and the high-speed mode. As shown in FIG. 5, the electromagnetic valve 27 comprises a valve body 51, a spool valve 52, a pilot valve 53, and a solenoid 54 for driving the pilot valve 53, where the valves 52, 53 are received in the valve body 51 so as to be moveable along respective axial lines which are parallel to each other.

The solenoid 54 is fastened to an end surface of the valve body 51 on the side of the camshaft 20, i.e., an upper end surface in FIG. 5. Within an air-core of the solenoid 54 is received a plunger 56 which is connected to the pilot valve 53 and always urged downward by a compression coil spring 55. In this way, a lower end of the pilot valve 53 is pressed against an opening of an orifice 58 provided at an outlet of an upstream-side pilot oil passage 57 that supplies a pilot pressure to the spool valve 52.

Opened in a surface of the valve body 51 facing the cylinder head 14 and arranged from top to down are: a drain port 60 connected to an engine oil return passage 59; an outlet port 62 connected to a supply passage 61 which in turn is connected to the oil supply passage 43 of the rocker shaft 33; and an inlet port 64 connected to an engine oil discharge passage 63 from the pump P. Among these ports, the inlet port 64 is directly connected to the upstream-side pilot oil passage 57 while the outlet port 62 is connected to the upstream-side pilot oil passage 57 via an orifice 65.

The spool valve 52 is formed with, from top to down, a piston portion 66, an annular recessed portion 67 for allowing communication between the inlet and outlet ports, and a land portion 68 for blocking communication between the inlet and outlet ports, where these portions are arranged serially and the spool valve 52 is always urged in the upward direction resiliently by a compression coil spring 69 which is disposed at a lower end side of the spool valve 52 in a compressed state.

In a deactivated state of the electromagnetic valve 27 as shown in FIG. 5, the pilot valve 53 closes the orifice 58 due to the downward resilient force which is applied thereto from the coil spring 55 via the plunger 56. Therefore, the high oil pressure transmitted from the inlet port 64 to the upstream-side pilot oil passage 57 is blocked there. In this state, the land portion 68 of the spool valve 52 which is lifted by an upward resilient force of the coil spring 59 blocks the direct communication between the inlet port 64 and the outlet port 62. Thus, the engine oil which has flowed into the upstream-side pilot oil passage 57 from the inlet port 64 only flows into the outlet port 62 via the orifice 65 by an amount necessary for lubricating the valve gear mechanism. Consequently, the high oil pressure does not act upon the outlet port 62, keeping the valve operation characteristics switching device 29 in the low-speed mode.

When an electric current is supplied to the solenoid 54, the plunger 56 is lifted against the urging force of the coil spring 55, causing the pilot valve 53 to move upward. This opens the orifice 58 so that the high oil pressure in the upstream-side pilot oil passage 57 is transmitted to an upper surface of the piston portion 66 of the spool valve 52 through a downstream-side pilot oil passage 70 which is formed in the valve body 51 so as to extend obliquely in a downward direction. The high oil pressure causes the spool valve 52 to move downward against the resilient force of the coil spring 69. As a result, the land portion 68 moves downward, and the inlet port 64 and the outlet port 62 are directly connected to each other via the annular recessed portion 67. This allows the high oil pressure to be transmitted to the outlet port 62, causing the selective coupling pins 37, 39 to move to the right in the drawing so that the high-speed mode is achieved. In this state, excessive oil is discharged from the drain port 60 via an orifice 71 formed in the piston portion 66.

In the outboard motor 1 where an outer profile of the engine cover 8 should be as small as possible, it is not preferable that the above-described electromagnetic valve 27 projects out from the outer profile of the engine 4. Therefore, according to the present invention, the upper end surface of the exhaust manifold 23 and the upper end surface of the cylinder head 14 are offset from each other in the direction of axis of the crankshaft to thereby define the space G therebetween, and the electromagnetic valve 27 is disposed in the space G such that the electromagnetic valve 27 overlaps the upper end surface of the exhaust manifold 23. This can prevent the electromagnetic valve 27 from projecting out from the outer profile of the engine. Particularly, if the exhaust gas property sensor 28 is disposed on a camshaft-side end of the exhaust manifold 23, which extends from a joint with the cylinder head 14 to a lateral side of the camshaft 20, the open space formed for ensuring a sufficient length of the exhaust passage 24 can be utilized even more efficiently.

As described above, according to the present invention, the electromagnetic valve and the exhaust gas property sensor are disposed so as to be adjacent to each other in the front-to-back direction in a space which is formed beside an upper end portion of the cylinder head and which usually would be a dead space. This can allow the electromagnetic valve and the exhaust gas property sensor to be attached to the engine without an increase in the outer profile of a crank pulley-side end surface of the engine of the outboard motor. Therefore, the present invention is quite advantageous in achieving a more compact outboard motor.

Although the present invention has been described in terms of a preferred embodiment thereof, it is obvious to a person skilled in the art that various alterations and modifications are possible without departing from the scope of the present invention which is set forth in the appended claims.

What is claimed is:

1. An outboard motor, comprising:

an intake valve and an exhaust valve provided to a cylinder head;

a camshaft arranged substantially vertically in said cylinder head to open and close said intake and/or exhaust valves;

a valve operation characteristics changing device hydraulically operated to change operation characteristics of at least one of said intake and exhaust valves;

a selector valve for controlling an oil pressure provided to said valve operation characteristics changing device; and an exhaust passage component part secured on a side of said cylinder head, wherein said selector valve is disposed at a position beside said cylinder head and overlapping with a top end surface of said exhaust passage component part.

2. An outboard motor according to claim 1, further comprising an exhaust gas property sensor for sensing an exhaust gas property of an engine, wherein said exhaust gas property sensor is secured on said top end surface of said exhaust passage component part.

3. An outboard motor according to claim 2, wherein said selector valve and said exhaust gas property sensor are arranged in a front-to-back direction.

4. An outboard motor according to claim 2, wherein said exhaust passage component part extends from a joint with said cylinder head to a lateral side of said camshaft, and wherein said exhaust gas property sensor of said engine is disposed at an end portion of said exhaust passage component part closer to said camshaft.

5. An outboard motor according to claim 3, wherein said exhaust passage component part extends from a joint with said cylinder head to a lateral side of said camshaft, and wherein said exhaust gas property sensor of said engine is disposed at an end portion of said exhaust passage component part closer to said camshaft.

* * * * *